US010330368B2

(12) United States Patent
Devilbiss et al.

(10) Patent No.: US 10,330,368 B2
(45) Date of Patent: Jun. 25, 2019

(54) APPARATUS, METHOD AND SYSTEM FOR A DISPENSING SYSTEM OF A REFRIGERATED APPLIANCE

(71) Applicant: WHIRLPOOL CORPORATION, Benton Harbor, MI (US)

(72) Inventors: Grant J. Devilbiss, Saint Joseph, MI (US); Jonathan C. Valentine, Saint Joseph, MI (US); Tiemen T. Van Dillen, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 302 days.

(21) Appl. No.: 15/200,844

(22) Filed: Jul. 1, 2016

(65) Prior Publication Data

US 2016/0313044 A1 Oct. 27, 2016

Related U.S. Application Data

(62) Division of application No. 12/477,517, filed on Jun. 3, 2009, now Pat. No. 9,383,134.

(51) Int. Cl.

| | |
|---|---|
| ***F25D 23/12*** | (2006.01) |
| ***F25C 5/20*** | (2018.01) |
| ***B67D 1/00*** | (2006.01) |
| ***B67D 1/08*** | (2006.01) |
| ***F25D 23/04*** | (2006.01) |

(52) U.S. Cl.

CPC ..... *F25C 5/22* (2018.01); *B67D 1/001* (2013.01); *B67D 1/0014* (2013.01); *B67D 1/0878* (2013.01); *B67D 1/0888* (2013.01); *F25D 23/04* (2013.01); *F25D 23/126* (2013.01)

(58) Field of Classification Search

CPC ..... F25C 5/22; F25C 23/04; F25C 23/126; B67D 1/0014; B67D 1/0878; B67D 1/0888; B67D 1/001

See application file for complete search history.

(56) References Cited

U.S. PATENT DOCUMENTS

| | | | | |
|---|---|---|---|---|
| 4,446,896 | A | 5/1984 | Bumb | |
| 6,375,834 | B1 * | 4/2002 | Guess | B01D 35/143 210/138 |
| 6,613,236 | B1 * | 9/2003 | Guess | B01D 35/143 210/739 |
| 6,636,151 | B2 | 10/2003 | Busick | |
| 6,789,585 | B1 | 9/2004 | Janke | |
| 7,201,005 | B2 * | 4/2007 | Voglewede | F25D 23/126 222/146.6 |
| 7,210,601 | B2 * | 5/2007 | Hortin | B67D 1/0009 222/129.1 |
| 7,543,453 | B2 * | 6/2009 | Boarman | F25D 23/126 222/146.6 |
| 7,591,399 | B2 * | 9/2009 | Hortin | B67D 1/0009 222/129.1 |

(Continued)

*Primary Examiner* — Nicolas A Arnett
(74) *Attorney, Agent, or Firm* — Nyemaster Goode, P.C.

(57) ABSTRACT

An apparatus, method and system for sensing parameters related to water and/or ice being dispensed from a dispensing station of a refrigerated appliance is disclosed. The dispensing system includes a sensing system positionable at the dispensing station at the point of dispension for liquid and/or ice to sense a parameter related to dispensed water and/or ice and produce a sensing signal.

19 Claims, 9 Drawing Sheets

(56) References Cited

U.S. PATENT DOCUMENTS 7,673,661 B2 * 3/2010 Chase ..... B67D 1/0858 141/360
7,690,403 B2 * 4/2010 You ..... B67D 1/0871 141/198
7,743,801 B2 * 6/2010 Janardhanam ..... F25D 23/126 141/351
7,770,408 B2 8/2010 Kim et al.
8,151,596 B2 * 4/2012 Richmond ..... G01F 11/284 62/389
8,245,735 B2 * 8/2012 Chase ..... B67D 1/001 141/1
8,322,384 B2 * 12/2012 Ashrafzadeh ..... F25D 23/126 141/192
8,327,889 B2 * 12/2012 Ashrafzadeh ..... B67D 1/0858 141/192
8,353,321 B2 * 1/2013 Agam ..... B67D 1/124 141/198
8,695,646 B2 * 4/2014 Agam ..... A47J 31/44 141/198
8,714,210 B2 * 5/2014 Ashrafzadeh ..... F25D 23/126 141/192
8,813,794 B2 * 8/2014 Ashrafzadeh ..... B67D 1/0858 141/94
9,020,635 B2 * 4/2015 Hortin ..... F25D 23/126 222/129.1
9,057,556 B2 * 6/2015 Ashrafzadeh ..... B67D 1/001
9,126,818 B2 * 9/2015 Chase ..... B67D 1/0858
9,297,577 B2 * 3/2016 Anselmino ..... F25D 23/126
9,365,406 B2 * 6/2016 Hortin ..... F25D 23/126
9,383,134 B2 * 7/2016 Devilbiss ..... F25D 23/126
9,499,384 B2 * 11/2016 Chase ..... B67D 1/0858
9,533,867 B2 * 1/2017 Hortin ..... F25D 23/126
9,568,240 B2 * 2/2017 Hall ..... B67D 7/82
9,702,619 B2 * 7/2017 Kendall ..... F25D 27/005
9,803,914 B2 * 10/2017 Anselmino ..... F25D 23/126
9,828,228 B2 * 11/2017 Chase ..... B67D 1/0858
9,908,768 B2 * 3/2018 Ashrafzadeh ..... B67D 1/001
9,957,147 B2 * 5/2018 Ka ..... B67D 1/1277
2005/0268639 A1 12/2005 Hortin et al.
2007/0272019 A1 * 11/2007 Agam ..... B67D 1/124 73/628
2008/0066475 A1 * 3/2008 Cho ..... A23L 3/26 62/130
2008/0105331 A1 * 5/2008 You ..... B67D 1/0871 141/198
2008/0156823 A1 * 7/2008 Kim ..... F25C 5/22 221/13
2008/0245081 A1 * 10/2008 Shin ..... F25D 23/12 62/80
2009/0183796 A1 7/2009 Chase et al.
2009/0314801 A1 * 12/2009 Ashrafzadeh ..... B67D 1/0858 222/64
2010/0308073 A1 * 12/2010 Devilbiss ..... F25D 23/126 222/1
2011/0036452 A1 * 2/2011 Schnyder ..... B67D 1/0005 141/83
2012/0102993 A1 * 5/2012 Hortin ..... F25D 23/126 62/189
2012/0104023 A1 * 5/2012 Anselmino ..... F25D 23/126 141/1
2012/0138629 A1 * 6/2012 Ashrafzadeh ..... B67D 1/0858 222/1
2013/0000337 A1 * 1/2013 Krause ..... B67D 1/0888 62/177
2013/0325173 A1 * 12/2013 Crisp, III ..... B67D 1/0057 700/236
2014/0202591 A1 * 7/2014 Schnyder ..... B67D 1/0005 141/95
2014/0319168 A1 * 10/2014 Chase ..... B67D 1/0858 222/1
2015/0053302 A1 * 2/2015 Willis ..... F25D 23/126 141/1
2015/0175401 A1 * 6/2015 Hortin ..... F25D 23/126 222/52
2015/0353337 A1 * 12/2015 Chase ..... B67D 1/0858 222/1
2016/0209106 A1 * 7/2016 Anselmino ..... F25D 23/126
2016/0238305 A1 * 8/2016 An ..... F25D 23/12
2016/0238309 A1 * 8/2016 An ..... B67D 1/0004
2016/0264395 A1 * 9/2016 Hortin ..... F25D 23/126

* cited by examiner

APPARATUS, METHOD AND SYSTEM FOR A DISPENSING SYSTEM OF A REFRIGERATED APPLIANCE

CROSS-REFERENCE TO RELATED APPLICATION

This application is a division of U.S. patent application Ser. No. 12/477,517, filed on Jun. 3, 2009, entitled "APPARATUS, METHOD AND SYSTEM FOR A DISPENSING SYSTEM OF A REFRIGERATED APPLIANCE," the disclosure of which is hereby incorporated herein by reference in its entirety.

FIELD OF THE INVENTION

The present invention relates to sensing parameters related to dispensed water and/or ice from the dispensing system of a refrigerated appliance. More particularly, the present invention relates to an apparatus, method and system for sensing parameters relating to dispensed water and/or ice from a dispensing system of a refrigerated appliance.

BACKGROUND

Dispensing liquid and/or ice from an in-door dispenser or refrigerator is well-known. In fact, many existing refrigerators, whether in a home, business or on the showroom floor, have an in-door dispenser for dispensing water and/or ice. These in-door dispensers lack a sensing system for sensing parameters relating to water and/or ice at the outlet for liquid and/or ice dispension points.

What is needed is an efficient and effective apparatus, method and system for sensing parameters relating to dispensed water and/or ice from the dispensing system of a refrigerated appliance.

Therefore, it is a primary object, feature or advantage of the present invention to improve over the state of the art.

It is a further object, feature, or advantage of the present invention to provide state of the art apparatuses, methods and systems for sensing parameters related to ice and/or water dispension from the dispensing station of a refrigerated appliance.

Another object, feature, or advantage of the present invention is to provide a module attachable about the dispensing station of a refrigerated appliance to provide a sensing of parameters relating to dispensed water and/or ice from the dispensing station.

A still further object, feature or advantage of the present invention is to provide a sensing module adapted for removable mounting at the dispensing station of a refrigerated appliance wherein the module is aesthetically complementary to the dispensing station and/or the refrigerated appliance.

Yet another object, feature, or advantage of the present invention is to provide a sensing module for a dispensing station of a refrigerated appliance that is seamlessly integratable at the dispensing station.

A still further object, feature, or advantage of the present invention is to provide a sensing system for a dispensing station of a refrigerated appliance fix providing notification or warnings to an operator or user regarding sensed parameters relating to the water and/or ice being dispensed.

Yet another object, feature, or advantage of the present invention is to provide a sensing system for a dispensing station of a refrigerated appliance that monitors parameters related to dispensed water and/or ice to provide diagnostics information regarding the refrigerated appliance, water, ice and/or the dispensing station.

These and/or other objects, features, or advantages of the present invention will become apparent. No single embodiment of the present invention need achieve all or any particular number of the foregoing objects, features or advantages.

BRIEF SUMMARY OF THE INVENTION

According to one aspect of the present invention a refrigerated appliance is disclosed. The refrigerated appliance includes a housing, a dispensing system at the housing having a dispensing station and a dispensing outlet positioned to dispense water and/or ice at the dispensing station. The refrigerated appliance also includes a sensing system at the dispensing system adapted to sense a parameter related to dispensed water and/or ice and produce a sensing signal.

According to another aspect of the present invention, a method of dispensing water and/or ice from a refrigerated appliance is disclosed. The method includes initiating dispension of water and/or ice and sensing a parameter related to water and/or ice at or near the dispension. In a preferred form, the method also includes monitoring the parameter to determine if the parameter meets a predetermined criteria.

According to another aspect of the present invention, a sensing system for use with a dispensing system of a refrigerated appliance is disclosed. The system includes a sensor adapted to sense a parameter related to water and/or ice dispension from the refrigerated appliance and produce a sensing signal and a controller in operative communication with the sensor and adapted to process the sensing signal.

DETAILED DESCRIPTION OF THE PREFERRED EMBODIMENT

The present invention is directed towards a sensing system for sensing parameters related to dispense water and/or ice from a dispensing system of a refrigerated appliance.

Apparatus

Figure 1A:
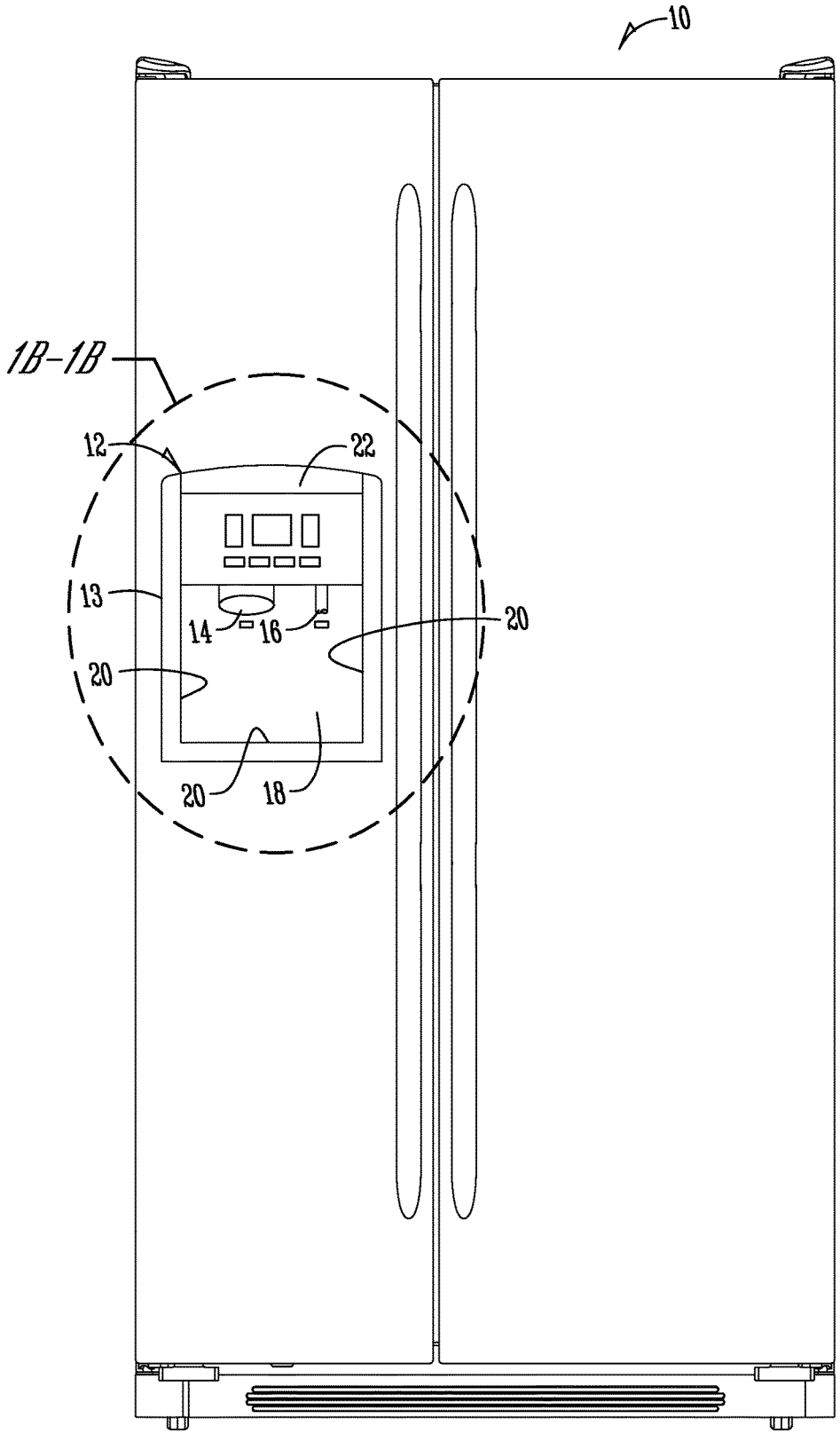
FIG. 1A is a front elevation view of a refrigerated appliance with a dispensing system having a sensing system for water and/or ice dispension according to an exemplary embodiment of the present invention.
Figure 1B:
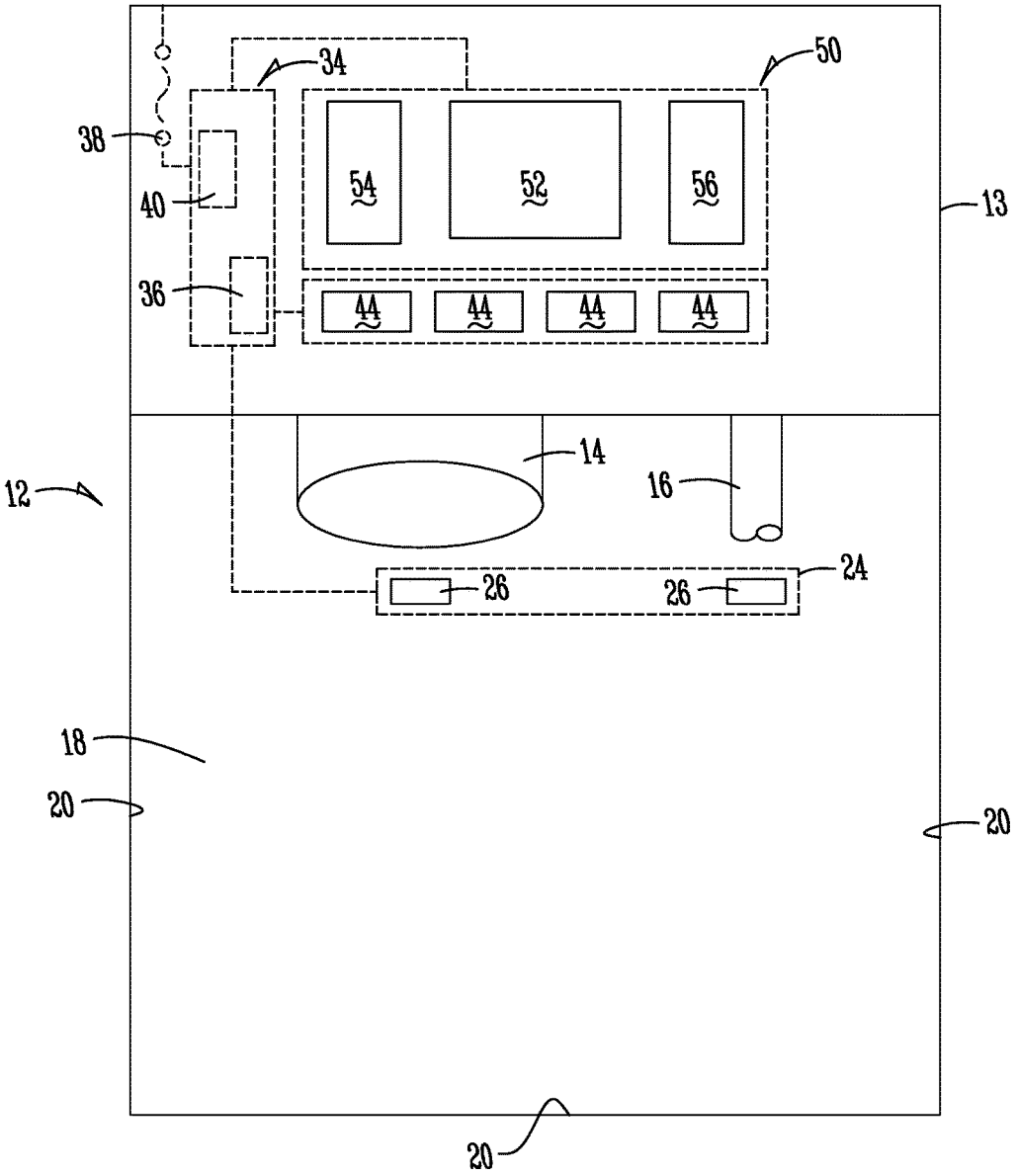
FIG. 1B is an enlarged view of the dispensing system taken along line 1B-1B in FIG. 1A illustrating various operating components of the dispensing system according to one embodiment of the present invention.
Figure 2A:
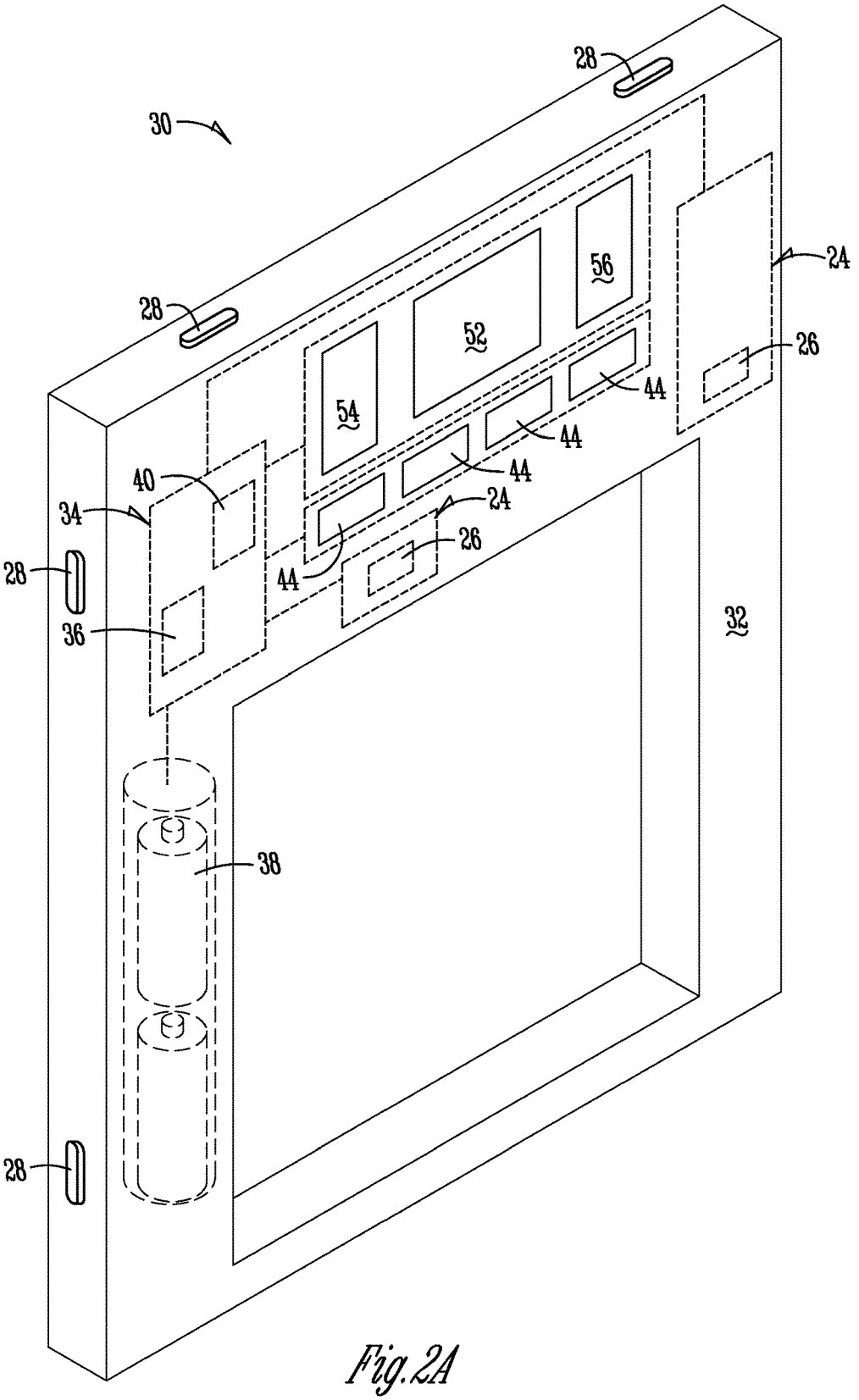
FIG. 2A is a perspective view of a removable sensing module according to an exemplary embodiment of the present invention.
Figure 2B:
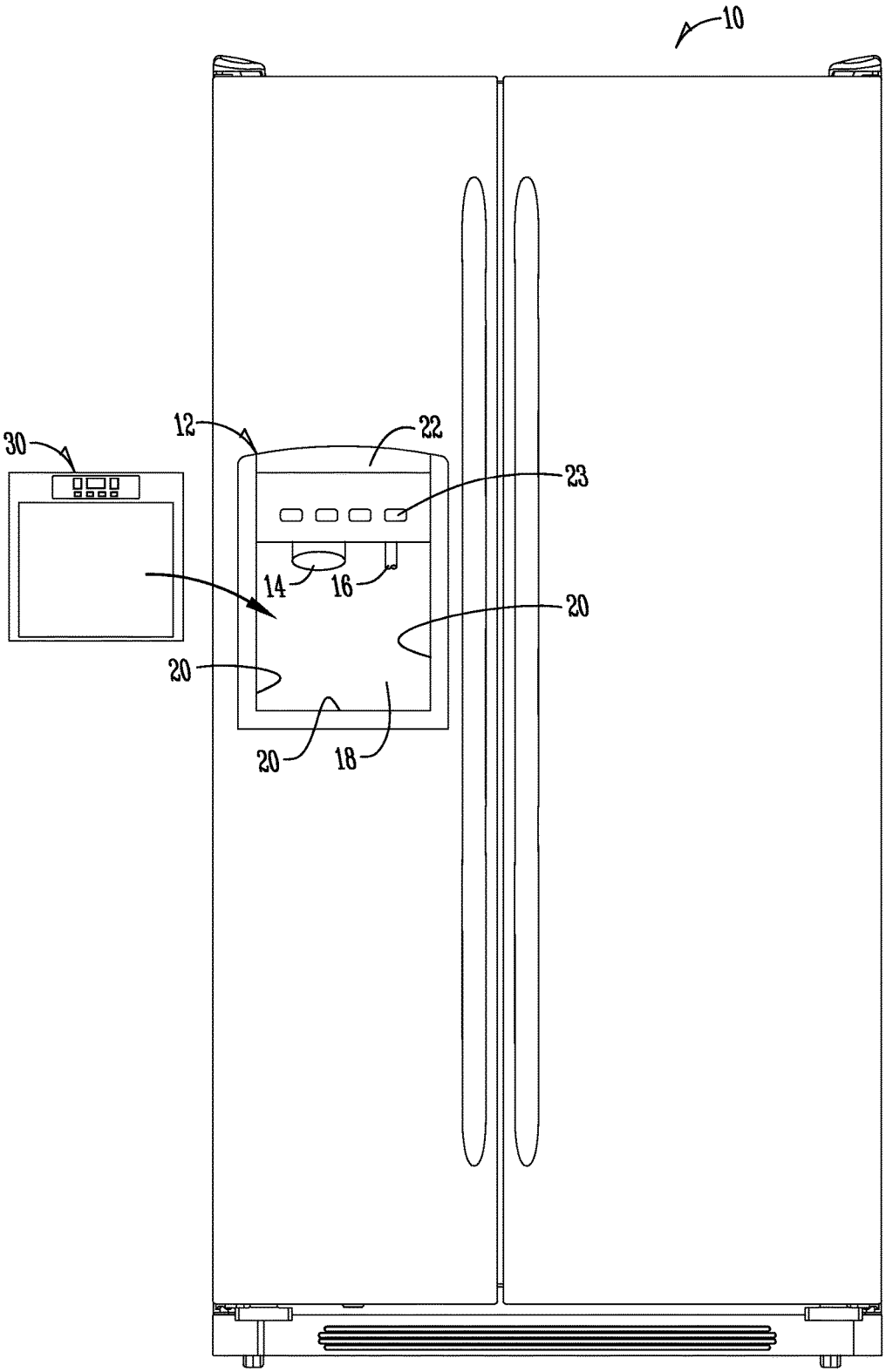
FIG. 2B is a front elevation view of the sensing module shown in FIG. 2A being mounted at the dispensing station of a refrigerated appliance according to an exemplary embodiment of the present invention.
Figure 2C:
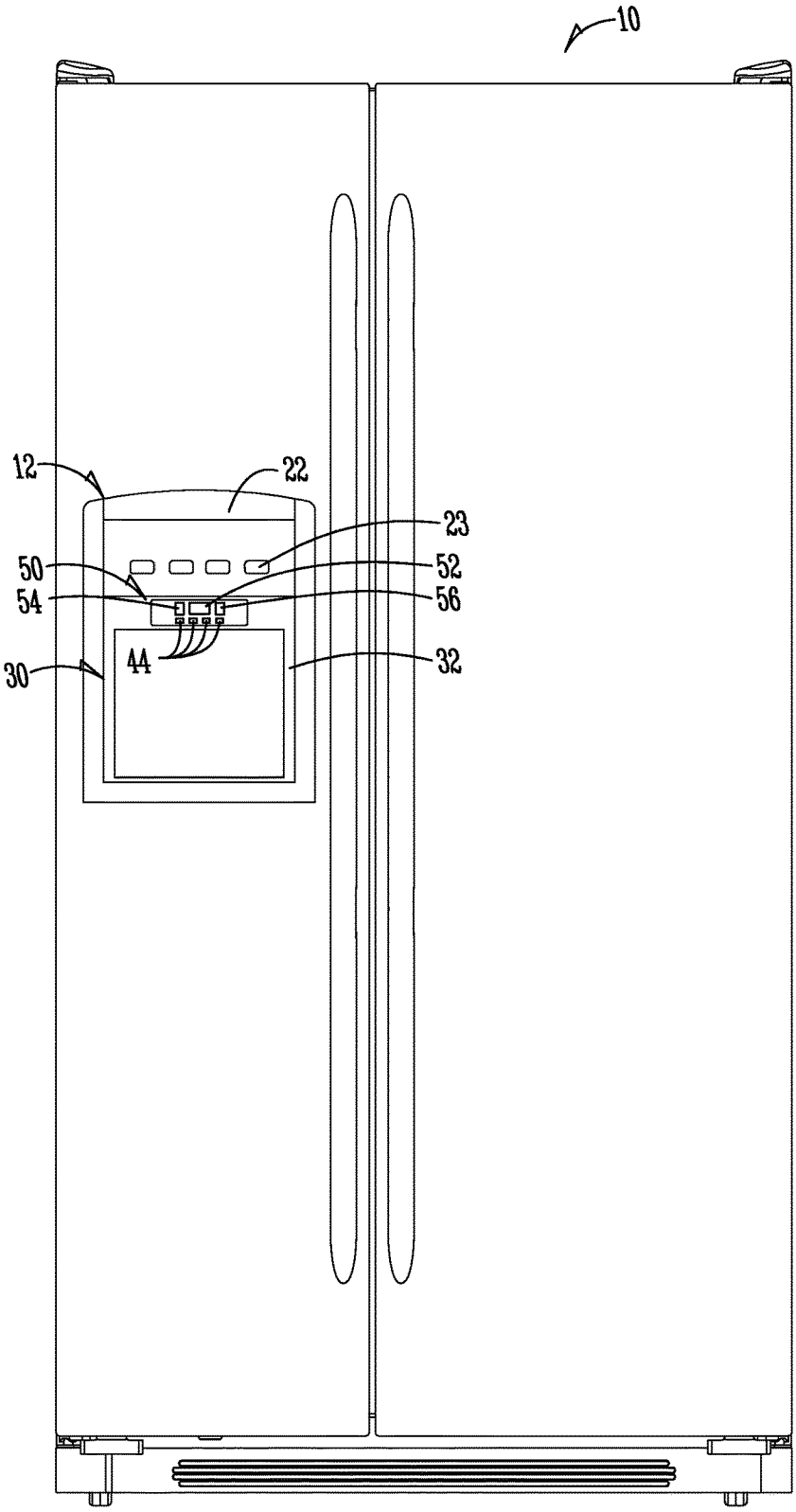
FIG. 2C is a front elevation view of the removable sensing module mounted at the dispensing station of the refrigerated appliance shown in FIG. 2B according to an exemplary embodiment of the present invention.
Figure 3A:
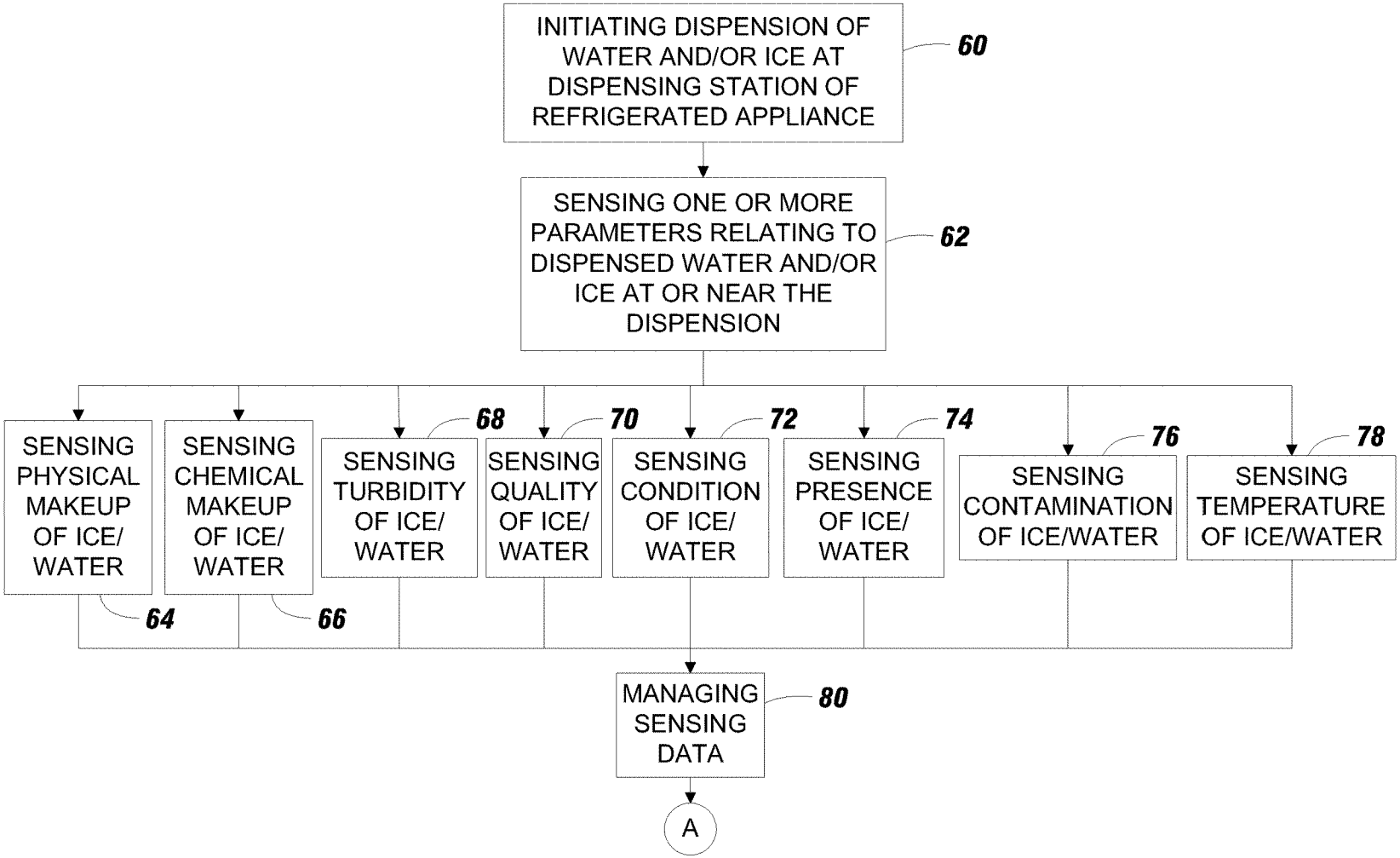
FIG. 3A-3D are flow charts of a method of the present invention.
Figure 3B:
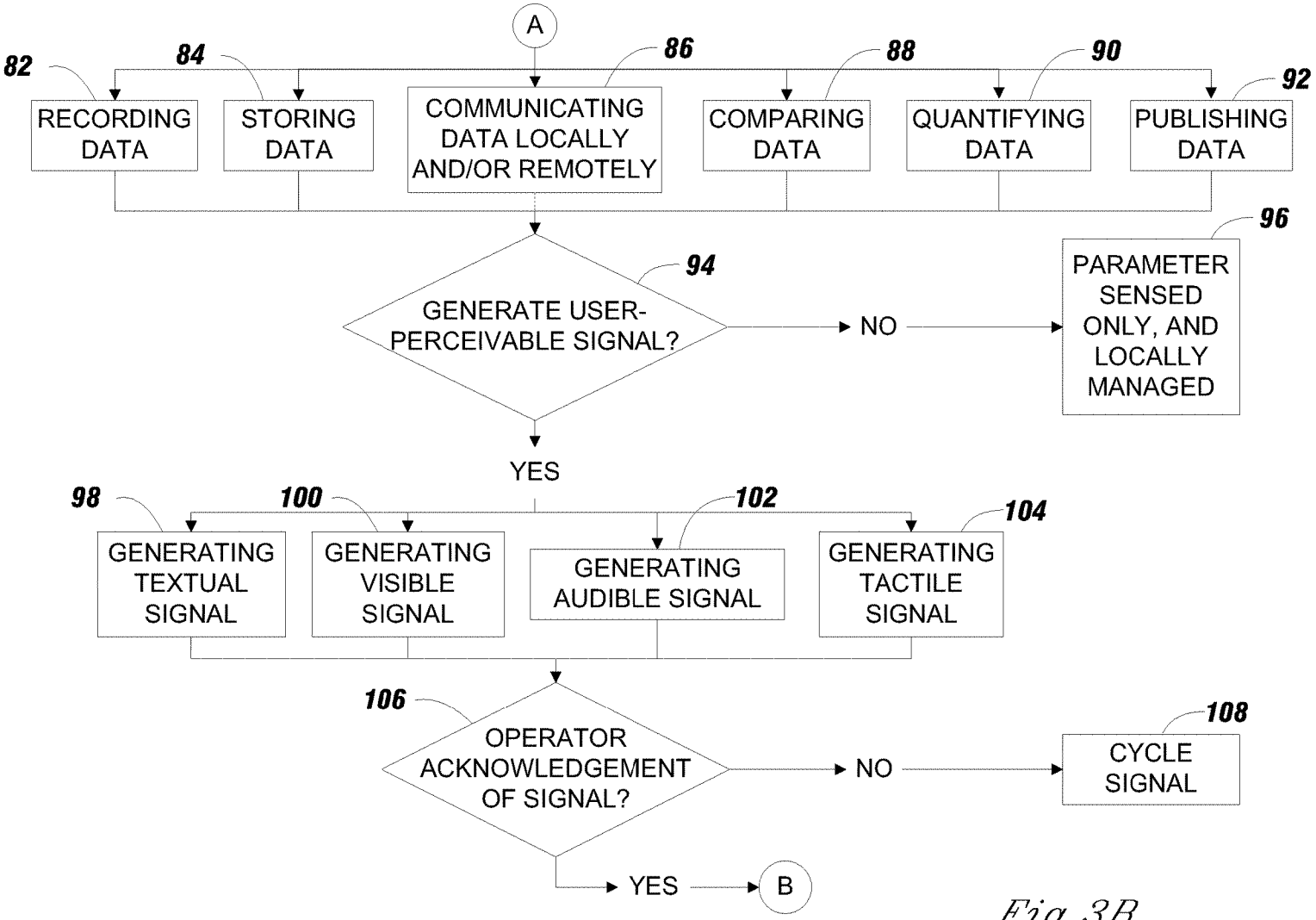
Figure 3C:
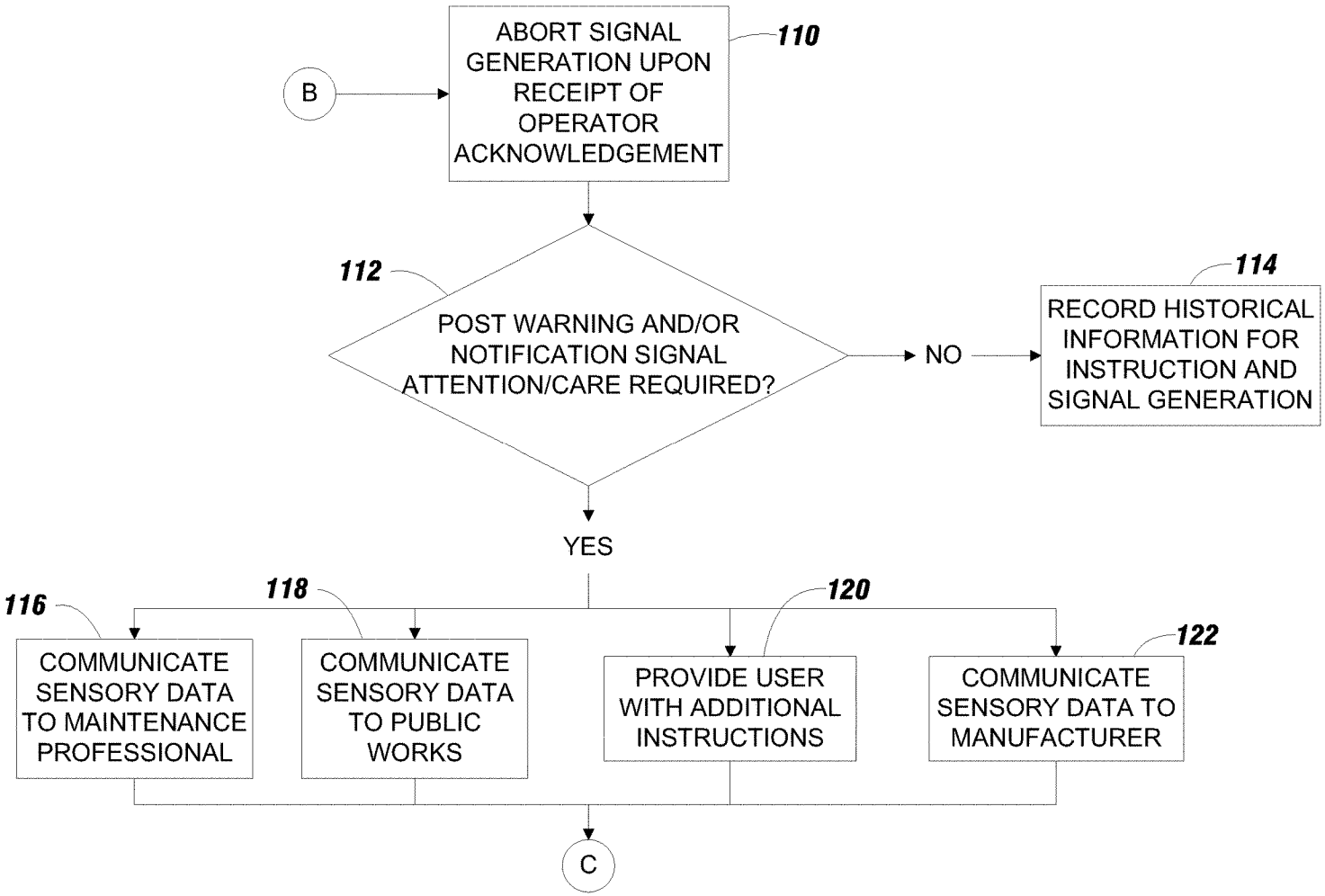
Figure 3D:
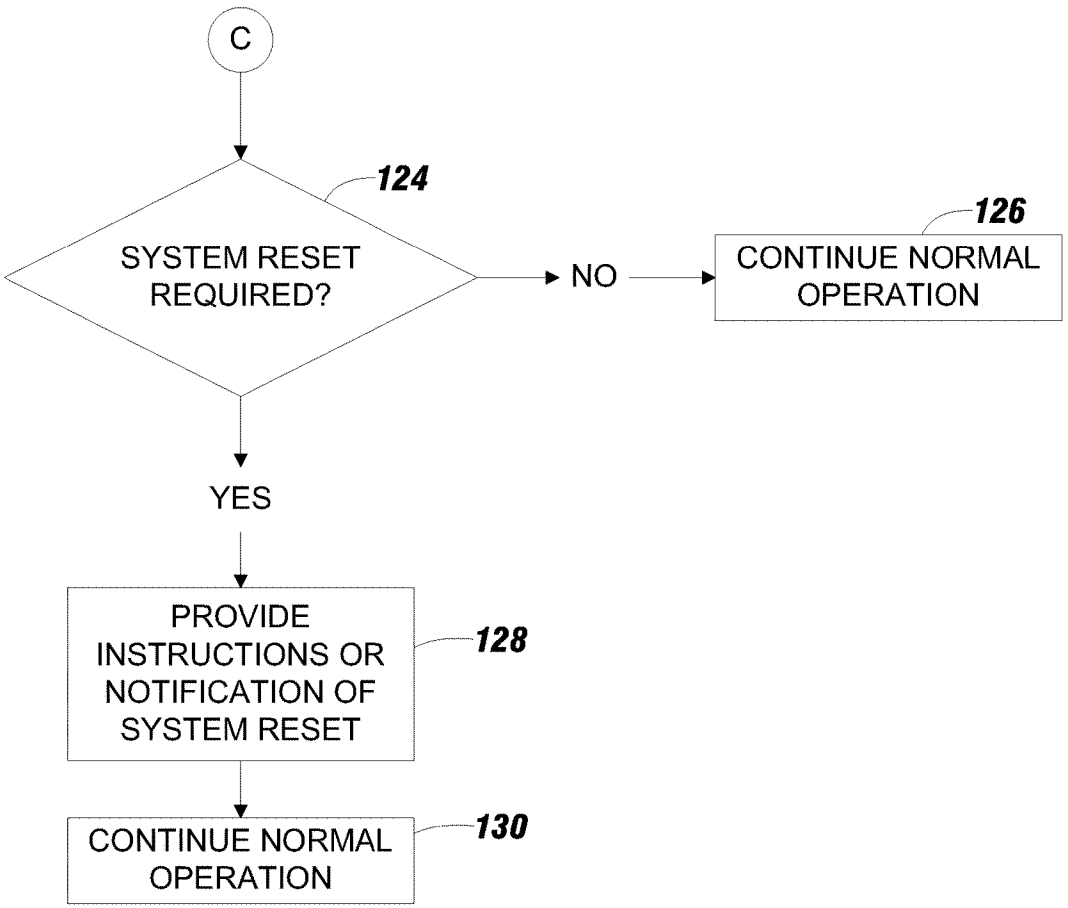

FIGS. 1-2C illustrate exemplary embodiments of the present invention. According to one embodiment of the present invention. FIG. 1A illustrates a refrigerated appliance 10 according to an embodiment of the present invention. Refrigerated appliance 10 may include one or both of a refrigerated compartment and a freezer compartment. The refrigerated and/or freezer compartments are enclosed by one or more doors hingedly attached to a cabinet body. A dispensing station 12 is positioned at the body of the refrigerated appliance, and customarily in one of the doors. Dispensing station 12 could be positioned at the door, either on the exterior or interior of the refrigerated appliance 10. The present invention is not limited to refrigerated appliances having a dispensing station as illustrated, but extends to all types of liquid dispensing units that have a dispensing station such as free standing, shelf or cabinet water dispensers. As is customary, dispensing station 12 may include an ice dispenser 14 and/or water dispenser 16 to provide dispension of both liquid and ice from dispensing station 12. Ice and liquid dispension occurs at housing 13 of dispensing station 12. Within housing 13 of dispensing station 12 is a dispensing area 18. Dispensing area 18 provides a space concomitant with dispension points where liquid and/or ice may be captured by a receptacle. Dispensing area 18 may be recessed into the door or protrude from the general plane of the door, and is defined generally by dispensing area walls 20. Dispensing area walls 20 partially enclose liquid and/or ice dispension from ice dispenser 14 and/or water dispenser 16 at dispensing station 12. Dispensing station 12 includes a dispensing area face 22 having dispensing station controls 23 for operating, monitoring or controlling dispensing station 12.

As best illustrated in FIG. 1B, illustrating an enlarged view of dispensing station 12 shown in FIG. 1A, dispensing station 12 also includes a sensing system 24 at dispensing station 12 adapted to sense a parameter related to dispensed water and/or ice from water dispenser 16 and/or ice dispenser 14. The sensing system 24 is further adapted to produce a sensing signal based on the sensed parameter relating to dispensed water and/or ice. Preferably, one or more sensors may be positioned at points of dispension for ice dispenser 14 and/or water dispenser 16. Thus, one or more parameters relating to the dispensed ice and/or water may be detected using one or more sensors 26 positioned at points of dispension for water dispenser 16 and/or ice dispenser 14. Sensors 26 may include one or more types of sensors such as, but not limited to, a flow meter, a water quality meter, a spectral sensor, a temperature gauge, an optical fiber sensor, a motion sensor, a sonar sensor, a conductivity sensor, a capacitive sensor, a inductive sensor, an optical sensor, a light sensor, or a pH sensor. With one or more of the aforementioned sensors positioned at dispension points for water and/or ice at dispensing station 12, several parameters relating to the water or ice being dispensed may be monitored. For example, sensed parameters may include, but are not limited to, such parameters as quantity, quality, condition, presence or non-presence of certain substances, contamination, turbidity, temperature, chemical make-up, or physical make-up. Sensors 26 could be used to monitor water and/or ice consumption on a global or per user basis by using known information such as the flow rate for the ice and/or water per unit of time. Sensors 26 are configured to produce a sensing signal based on the parameters sensed from liquid and/or ice dispension. The term "dispension" is used to indicate that the water and/or ice has already been dispensed, and thus sensing is performed on the dispensed water outside and/or at the outlet of the dispensing line or conduit through which the water and/or ice is transported. A control system 34 is in operative communication with sensing system 24. The control system 34 and sensing system 24 may be configured to communicate with each other by wired or wireless connections. According to another aspect, sensors 26 at the outlet points for water and/or ice dispension could be configured to wirelessly communicate sensed information to a control board at a location remote to the dispensing area. For example, in one aspect, the system could include as a single-piece unit a power source (e.g., battery) for powering in combination with a Wi-Fi transmitter having a control board that acquires the sensed signal and transmits it using the onboard Wi-Fi functionality of the transmitter. Control system 34 may be configured to record, store, compare, quantify, publish, and/or communicate sensing data locally or remotely. Remote communication of data to a receiving location, data store or processing station could occur using data telemetry means known in that art. Similarly, remote communications of instructions or data to control system 34 could occur using data telecommand means known in the art. In one aspect, sensing system 24 may be configured to transmit and receive wireless signals from other accessories, whether on the refrigerated appliance 10, or another appliance or system having data telemetry means. In another aspect, sensing system 24 may be configured with a scanner, such as an RFID scanner, configured to read and inventory data available via RFID tags associated with things in and around the refrigerated appliance 10 (e.g., age or use sensitive perishable or non-perishable products or components). Sensors 26 may be configured to multiplex with control system 34 to perform any one or more of the aforementioned functions. Control system 34 may include one or more data stores for recording or storing sensing data. Control system 34 may also include a controller 36. A controller 36, which may be a programmable controller such as a programmable logic controller (PLC), is in operative communication with sensors 26 and data store 40. In a preferred embodiment, control system 34 is in operative communication with user notification system 50. Notification of a sensed parameter meeting a certain criteria determined by control system 34 may be communicated to user notification system 50 from control system 34. User notification of the sensed parameter may be provided by at the dispensing station 12 via visible, audible, and/or tactile signals. For example, user notification system 50 at dispensing area face 22 of dispensing station 12 may include a light or display 52 for providing a visible signal for notifying the user, a sound generator such as loud speaker 54 for notifying the user using an audible signal, or a tactile signal generator such as tactile sensation source 56 for providing a tactile signal for notifying the user of the sensed parameter or information relating thereto. Display 52 may include, in addition to light signals, a textural display for notifying user of the sensed parameter relating to liquid and/or ice dispensed from dispensing station 12. Dispensing station 12 preferably includes a user interface system 42 for receiving commands from a user via controls 44. User interface system is in electrical communication with control system 34 whereby user input at controls 44 is communicated to control system 34 for controlling controller 36, data store 40, user notification system 50 and/or sensing system 24. Control system 34, user notification system 50, user interface system 42 and sensing system 24 are in electrical communication with a power source 38. The present invention contemplates the power source 38 may include the refrigerated appliance 10, an electrochemical cell (i.e., an alkaline or rechargeable battery), a photovoltaic cell, or a power generator operated by water and/or ice dispension. In the case where power source 38 is a photovoltaic cell, the photovoltaic cell may be mounted externally for capturing ambient light and/or near an existing light source of refrigerated appliance 10 for capturing light emitted internally or externally from refrigerated appliance 10. The present invention further contemplates power source 38 being an inductive power source.

FIGS. 2A-C illustrate another embodiment of the present invention. FIG. 2A illustrates a sensing module 30 configured for removable mounting at the dispensing station of a refrigerated appliance. Module 30 is configured in height, width, depth dimensions to fit seamlessly (i.e., removably mounted) within the dispensing area of a dispensing station in any commercial refrigerated appliance such as illustrated in FIGS. 2B-C. Much like a picture frame, module 30 includes top, bottom and side walls that mate to dispensing area walls 20 of a dispensing station. Another embodiment of module 30 could include side walls connected to a top wall. Still another embodiment of module 30 could include adjustable sidewalls, top and/or bottom walls for accommodating varying size dispensing areas of a refrigerated appliance or other liquid dispenser. Another embodiment of module 30 could include a narrow rectangular (non-frame-like) body configured for removable mounting to one of the walls 20 at dispensing station within proximity to dispension points for ice dispenser 14 and/or water dispenser 16. For example, module 30 in this form could be fit or adhered to the top or side wall 20 of dispensing station. To remain seated within dispensing area 18 of dispensing station 12, frame 32 of module 30 may include one or more attachments 28 for securing to dispensing area walls 20 of dispensing station 12. Module 30 may also be configured for receipt within the dispensing area 18 and remain attached to dispensing area using a compression or friction fit whereby module 30 fits sufficiently snug within dispensing area 18 of dispensing station 12 to retain module 30 at the dispensing station 12. In a preferred form, module 30 includes an exterior portion adapted to fit with a complementary portion of the dispensing station 12. Further, frame 32 of module 30 may include exterior portions that are configured cosmetically to match dispensing area face 22 of dispensing station 12 or other cosmetic or design features of the host appliance. Module 30 may include one or more faceplates for being adaptable to different brands, makes and models of refrigerated appliances. Configured into frame 32 of module 30 are many of the same operational components as discussed supra relating to the embodiment of the present invention shown in FIGS. 1 and 2. When module 30 is seated within dispensing area 18 of dispensing station 12, sensors 26 associated with sensing system 24 are positioned at dispension points for ice dispenser 14 and/or water dispenser 16. As previously indicated, sensors 26 are configured to sense a parameter related to water and/or ice dispension. The measured parameters are electrically communicated to control system 34 where controller 36 processes the information. Control system 34 is in electrical communication with user notification system 50 for alerting the user of the sensed parameter relating to ice and water dispension. As noted previously, user notification system may include a visual display 52, loud speaker 54 or tactile sensation source 56 for alerting the user of the sensed parameter. User interface system 42 is in electrical communication with control system 34. Instructions or input to the system from a user may be provided at controls 44 of control system 34. In one aspect of the present invention, alkaline or rechargeable batteries may be used as power source for powering control system 34, sensing system 24, user notification system 50 and/or user interface system 42. Module 30 may also be configured to receive AC power from refrigerated appliance 10 whereby wire connections associated with module 30 are connected to an electrical connection/tie-in within dispensing station 12 or associated with refrigerated appliance 10. Module 30 may also include a photovoltaic cell configured to convert ambient light sources into energy for use by module 30. A photovoltaic cell may also be positioned relative to an existing light source of the refrigerated appliance whereby light energy from the refrigerated appliance is used to power module 30. Module 30 may also include a power generator positioned at and operated by water and/or ice dispension for providing electrical energy for operating module 30. Thus, module 30 may be attached to a refrigerated appliance for monitoring or sensing parameters related to water and/or ice being dispensed from ice dispenser 14 and/or water dispenser 16. As previously indicated, sensors 26 may be used to monitor one or more parameters associated with liquid and/or ice dispension. Controller 36 of control system 34 may be used to process the sensed information to determine if it meets a certain criteria for alerting the user. Control system 34 may be also be configured to record or store the sensed information within data store 40 for later analysis and/or subsequent notification to the user. Thus, module 30 includes all the same functionalities and components of the dispensing station illustrated in FIGS. 1-2, but in a modulated form. Thus, module 30 may be retrofitted to any new or existing refrigerated appliance or liquid dispenser having a dispensing station where the ability to sense parameters related to water and ice dispension are desired. Further, using parameters gleaned from monitoring water and/or ice dispension, user notification may be given regarding the status of various components within the refrigerated appliance such as a water filter that is expired or an ice maker that is malfunctioning.

System

In another embodiment of the present invention a sensing system for use with a dispensing station of a refrigerated appliance or other liquid dispensing appliance is disclosed. In a preferred form, the sensing system of the present invention includes one or more sensors 26 adapted to sense a parameter related to water and/or ice dispension from a dispensing station 12 of a refrigerated appliance 10. The sensor 26 is further adapted to produce a sensing signal. The sensing signal is communicated control system 34 in operative communication with the one or more sensors 26. The control system 34 is configured to process the sensing signal received from sensing system 34. A user notification system is in operative communication with the control system 34. The user notifications system 50 is configured to generate a user-perceivable notification signal in response to the sensing signal received from sensing system 24. Control system 34 may include one or more data stores 40 whereby sensing data received from control system 34 may be stored or recorded within the control system 34. Sensing signal received from sensing system 24 may be processed in real-time or by post processing procedures or protocol programmed within controller 36 of control system 34. Depending upon the operating parameters or criteria programmed into controller 36, sensed information may be processed in real-time or post processed and a subsequent electronic signal sent to the user notification system 50 for providing a user-perceivable notification signal, such as a visible, audible, or tactile signal. Notification devices at the user notification system 50 provide notification to the user of the sensed parameter using a light source, a sound source, a tactile signal source or textual display source. Sensors 26 of sensing system 24 may be configured to monitor parameters relating to the liquid or ice being dispensed. For example, parameters such as quantity, quality, condition, presence, contamination, turbidity, temperature, chemical make-up, or physical make-up may be monitored and/or sensed. Appropriate sensors 26, such as those listed supra, may be positioned at dispersion points for ice and/or water at the dispensing station 12 for monitoring a parameter relating to the ice and/or water being dispensed. In sensing system 24, control system 34 user interface system 42 and user notification system 50 may be configured into a module 30 that is configured for being removably mounted at a dispensing area of a refrigerated appliance or liquid dispenser. The module 30 may include a fixed or adjustable frame 32 portion adapted for being removably affixed to a complementary portion of the dispensing area 18 of dispensing station 12. One or more of the exterior portions of module 30 may be configured cosmetically to match complementary portions of dispensing station 12. For example, various cosmetically arrayed faceplates may be configured to match the dispensing area face 22 of dispensing station 12. A user may provide input to the sensing system by way of controls 44 at user interface 42. Module 30 may be configured to receive power from a power source 38. For example, the sensing system may include an on-board power source 38 such as rechargeable power source. Alternatively, the sensing system may be configured to receive power from the refrigerated appliance 10, such as where the module 30 is electrically tied into a power source aboard the refrigerated appliance 10. In the modulated form, the sensing system may be configured whereby the module 30 is rechargeable offline and when fully charged reinserted into the dispensing area 18 of dispensing station 12. Furthermore, module 30 may include a power pack adapted for receipt within module 30 that may be removed for offline charging and reconnected to module 30 for powering operation of the module 30.

Method

FIGS. 3A-D illustrate a method of the present invention. According to one method, a module 30 is seated within dispensing area 18 of dispensing station 12. Or, in the case where refrigerated appliance 10 includes sensing system 24, the operator in either case initiates dispersion of water and/or ice at dispensing station 12 of refrigerated appliance (step 60). Liquid and/or ice being dispensed from ice dispenser 14 and/or water dispenser 16 is monitored by sensor 26 for sensing one or more parameters relating to water and/or ice being dispensed from ice dispenser 14 and/or water dispenser 16. Sensor 26 senses parameters relating to the water and/or ice at or near the point of dispension (see step 62). Steps 64-68 illustrate sensed parameters of the liquid candor ice being dispensed. Sensed parameters may include, but are not limited to, sensing physical make-up of ice and/or water being dispensed, sensing chemical make-up of ice or water being dispensed, sensing turbidity of ice and water being dispensed, or sensing quality of the ice or water being dispensed. Further sensed parameters include sensing for the presence of ice and/or water, sensing for contamination of the ice and/or water, or sensing the temperature of the ice and/or water being dispensed. Further methods of the present invention contemplate sensing other parameters gleanable or perceivable from monitoring or analyzing the liquid and/or ice being dispensed from ice dispenser 14 or water dispenser 16. Sensing data from sensor 26 is communicated electronically from sensing system 24 to control system 34. A controller 36 within control system 34 manages sensed data (step 80). Controller 36 operating under instruction from on-board code within the controller or code programmed into the controller remotely, manages the data provided from sensor 26. Data management, as illustrated in steps 82-92, includes recording or storing data in data store 40. Further management of data may include publishing data to as local or remote source, including making data available by communicating data locally or remotely via a computer network to an enterprise database associated with the business or a service company associated with providing service for the refrigerated appliance. Other data management include comparing, contrasting or quantifying the data by real or post-time processing protocols. The control system 34 also manages the sensory data to determine if a user-perceivable signal should be generated (step 94). Control system 34 may opt to process and manage sensory data internally without apprizing the user, such as for example where sensory data is stored for post-processing purposes (step 96). In the case where it is desirable to notify the user of the sensed data or information gleaned from processing the sensed data, a user notification signal such as a user-perceivable signal is given. Steps 98-104 illustrate various user-perceivable signals for alerting the user. These steps include generating a textual signal, generating a visual or visible signal, generating an audible signal, or generating a tactile signal. If no operator acknowledgement of the signal generated is required (step 106) the control system 34 will cycle the signal (step 108) based on the number of cycles programmed into controller 36. If user acknowledgement of the signal is required, control system 34 aborts signal generation upon receipt of an instruction from a user at controls 44 of user interface system 42 acknowledging receipt or appreciation of the signal being provided (step 110). Control system 34 may be configured to require attention or care depending upon the parameter sensed from the liquid or ice being dispensed. In the case where no attention or care is required (step 112), control system 34 may be configured to record historically the sensed parameters for subsequent instruction and signal generation, or for deriving historical information about the liquid and/or ice being dispensed from the refrigerated appliance (step 114). In the case where attention or care is required upon acknowledgement of a parameter sensed from liquid and/or ice dispension, control system 34 may be configured to communicate sensory data to a maintenance professional (step 116) to provide necessary services to the refrigerated appliance, the ice dispenser or liquid dispensing system of the refrigerated appliance (step 116). In the case where the parameter sensed from the water or ice being dispensed relates to the quality of the liquid and/or ice such as where a foreign or unwanted chemical is identified within the water and/or ice, sensory data may be communicated to public works to notify them of such issues (step 118). Control system 34 may also be configured to provide a user with additional instructions (step 120) relating to the attention or can required given the parameter sensed from the liquid or water being dispensed. Further, control system 34 may be configured to communicate sensory data to the manufacturer of the refrigerated appliance (step 122) to alert the manufacturer of any problems or concerns relating to the refrigerated appliance. For example, in the case where water quality is identified as being poor as a result of filter life having expired, the manufacturer may be notified that the refrigerator in need of a new filter and the user subsequently notified and/or provided instructions on how to order or obtain a new filter for the refrigerated appliance. In some instances a system reset may be required (step 124), and if not, the system continues normal operation (step 126). Control system 34 may be configured to provide instructions or notification of a need for system reset (step 128) if the system reset is required. For example, in the case where the system identifies that the water quality is poor as a result of filter life having expired, the control system further identifies the need for a reset of a filter life counter associated with the system to know when to alert the user when the new filter expires. Upon receiving instruction and notification of the need to reset the system (step 128), the system continues normal operation (step 130) whereby sensor 26 monitors parameters relating to the water and/or ice being dispensed from ice dispenser 14 and/or water dispenser 16 of dispensing station 12.

The embodiments of the present invention have been set forth in the drawings and specification and although specific terms are employed, these are used in a generically descriptive sense only and are not used for the purposes of limitation. Changes in the formed proportion of parts, as well as in the substitution of equivalences are contemplated as circumstances may suggest or are rendered expedient without departing from the spirit and scope of the invention as further defined in the following claims.

What is claimed is:

1. A refrigerated appliance comprising:

a housing having a freezer compartment and a refrigerated compartment;

a dispensing system on an exterior of the housing and accessible from the exterior of the appliance by a user wherein the dispensing system dispenses ice and water from separate outlets and the dispensing system comprises: a dispensing station; an ice dispensing outlet positioned to dispense ice at the dispensing station; and a water dispensing outlet positioned to dispense water at the dispensing station;

a sensing system at the dispensing station that produces a sensing signal of a sensed water parameter of the water dispensed from the water dispensing outlet and related to the dispensed water and produces a sensing signal of a sensed ice parameter of the ice dispensed from the ice outlet and that is related to the dispensed ice; and wherein the sensing system senses the sensed water parameter: (1) outside the water dispensing outlet; or (2) at the water dispensing outlet through which the water is transported and wherein the sensing system senses the sensed ice parameter: (1) outside the ice dispensing outlet; or (2) at the ice dispensing outlet through which the ice is transported.

2. The refrigerated appliance of claim 1 further comprising:

a control system in operative communication with the sensing system wherein the control system operates to do one of the following: receive both the sensing signal of the sensed water parameter and the sensing signal of the sensed ice parameter; process the sensing signal of the sensed water parameter and the sensing signal of the sensed ice parameter; generate a response to a received sensing signal; and record the received sensing signal; and wherein the dispensing system delivers water and ice to a receptacle when the receptacle is positioned below the water dispensing outlet and the separate ice dispensing outlet respectively.

3. The refrigerated appliance of claim 2 further comprising a user notification system in operative communication with the control system and adapted to generate a notification signal in response to a control signal and wherein the dispensing system further comprises at least one sensor at each of the water dispensing outlet and the ice dispensing outlet.

4. The refrigerated appliance of claim 3, wherein the sensing system, the control system and the user notification system are integrated into a module removably affixed to a complementary portion of the dispensing station; and wherein the module comprises an attachment point adapted to removably affix to the complementary portion of the dispensing station to mount at the dispensing station and wherein the module comprises at least one exterior portion adapted to fit with the complementary portion of the dispensing station.

5. The refrigerated appliance of claim 4, wherein the module comprises a picture frame geometry having a faceplate adapted to seat flush against peripheral inner walls of the dispensing station to keep the water dispensing outlet and the ice dispensing outlet fully accessible.

6. The refrigerated appliance of claim 5, wherein the faceplate is removably attached to the picture frame geometry whereby the faceplate matching the complementary portion of the dispensing station may be selected.

7. The refrigerated appliance of claim 4, wherein the module further comprises a user control interface in operative communication with the control system for operating a plurality of the following: sensing system; a user notification system; control system; and a secondary system in operative communication with the module.

8. The refrigerated appliance of claim 4, wherein the module is in operative communication with an electric power source that electrically powers the module and wherein the power source for the module comprises at least one of: the refrigerated appliance; an electrochemical cell; a photovoltaic cell; a power generator operated by water dispensing or ice dispensing or both water and ice dispensing; inductive powering.

9. The refrigerated appliance of claim 8, wherein the photovoltaic cell is mounted:

locally at the module for capturing ambient light and/or exterior lighting associated with the dispensing system and the module; and/or remotely at the dispensing station near a light source for capturing lighting associated with the dispensing station.

10. The refrigerated appliance of claim 3, wherein the notification signal comprises one or more signal chosen from the group consisting of: a visible signal; an audible signal; a tactile signal.

11. The refrigerated appliance of claim 3, wherein the user notification system providing the notification signal comprises at least one device chosen from the group consisting of: a light; a sound generator; a tactile signal generator; and a textual display.

12. The refrigerated appliance of claim 3, wherein the control system further comprises a data store in operative communication with the user notification system and the sensing system and adapted to store/record the sensing signal and wherein the control system is configured to communicate sensory data to a manufacturer of the refrigerated appliance to alert the manufacturer of any problems or concerns relating to the refrigerated appliance and wherein the sensing system, the control system and the user notification system are integrated into the dispensing system.

13. The refrigerated appliance of claim 1, wherein the sensed water parameter comprises a sensed water parameter chosen from the group consisting of: water quantity; water quality; water condition; water contamination; water turbidity and user consumption over a period of time; and wherein the sensed ice parameter comprises a sensed ice parameter chosen from the group consisting of: ice quality; ice condition; ice contamination; temperature; chemical make-up; physical make-up; and user consumption over a period of time and wherein the sensing system senses the sensed ice parameter and the sensed water parameter using at least one sensor chosen from the group consisting of: a flow meter; a water quality meter; a spectral sensor; a temperature gauge; an optical fiber sensor; a motion sensor; a sonar sensor; a conductivity sensor; a capacitive sensor;

an inductive sensor; an optical sensor; a light sensor; and a pH sensor.

14. The refrigerated appliance of claim 1, wherein the sensing system further comprises an RFID scanner configured to read and inventory data available via RFID tags associated with an item or items that include the RFID tags in and around the refrigerated appliance.

15. The refrigerated appliance of claim 14, wherein the item or items are age or use sensitive perishable or non-perishable products or components.

16. A refrigerated appliance comprising:

a refrigerated appliance housing defining a freezer compartment and a refrigerated compartment therein;

an ice and/or water dispensing system positioned on an exterior of the housing and accessible from the exterior of the appliance by a user wherein the dispensing system comprises: a dispensing station; a water dispensing outlet positioned to dispense water at the dispensing station; and an ice dispensing outlet positioned to dispense ice at the dispensing station; and a sensing system for use with the dispensing system that senses (1) outside the water dispensing outlet and the ice dispensing outlet; or (2) at the water dispensing outlet through which the water is transported and at the ice dispensing outlet through which ice is transported and wherein the water dispensing outlet and the ice dispensing outlet are separate dispensing outlets and each of the water dispensing outlet and the ice dispensing outlet have a detectable intrinsic parameter that are detected near points of dispensing originating at the separate dispensing outlets for dispensing into a user's receptacle spaced within a dispensing receiving area of the dispensing system; and wherein the dispensing system further comprises: a sensor at each of the points of dispensing of the separate dispensing outlet in the dispensing receiving area in sensing communication with the points of dispensing; a sensing signal of at least one of the detectable intrinsic parameters from the water dispensing and the ice dispensing acquired by the sensor at at least one point of dispensing upon initiation of dispensing by an operator at a dispensing station of the refrigerated appliance; and a controller adapted to process the sensing signal.

17. The refrigerated appliance of claim 16 further comprising: a control system in operative communication with the sensing system wherein the control system operates to do one of the following: receive the sensing signal; process the sensing signal; generate a response to the sensing signal; and/or record the sensing signal; and a user notification system in operative communication with the control system and adapted to generate a notification signal in response to a control signal and wherein the dispensing system further comprises at least one sensor at each point of dispensing of the water dispensing outlet and the separate ice dispensing outlet; and wherein the refrigerated appliance further comprises a water dispensing outlet and a separate ice dispensing outlet that deliver water and ice respectively to a receptacle receiving area of the dispensing system positioned below the water dispensing outlet and the separate ice dispensing outlet.

18. The refrigerated appliance of claim 17, wherein the sensing system further comprises an RFID scanner configured to read and inventory data available via RFID tags associated with an item or items that include the RFID tags in and around the refrigerated appliance and wherein the item or items are age or use sensitive perishable or non-perishable products or components.

19. A refrigerated appliance comprising:

a housing having a freezer compartment and a refrigerated compartment;

a dispensing system on the exterior of the housing and accessible from the exterior of the appliance by a user wherein the dispensing system comprises: a dispensing station; water dispensing outlet positioned to dispense water at the dispensing station; and an ice dispensing outlet positioned to dispense ice at the dispensing station; and a sensing system at the dispensing station that senses: (1) outside the water dispensing outlet through which water dispensed and/or outside the ice dispensing outlet through with ice is dispensed or (2) at the water dispensing outlet and/or at the ice dispensing outlet and wherein the sensing system produces a sensing signal of a sensed parameter that is related to the dispensed ice and/or water; and a control system in operative communication with the sensing system wherein the control system operates to do one of the following: receive the sensing signal; process the sensing signal; generate a response to the sensing signal; and/or record the sensing signal; and a user notification system in operative communication with the control system and adapted to generate a notification signal in response to a control signal and wherein the dispensing system further comprises at least one sensor at each point of dispensing of the water dispensing outlet and the separate ice dispensing outlet; and wherein the control system is configured to communicate sensory data to a manufacturer of the refrigerated appliance to alert the manufacturer of any problems or concerns relating to the refrigerated appliance and wherein the communicated sensory data is water quality and, when a water filter is identified as having expired by sensing the water quality, the manufacturer is notified that the refrigerated appliance is in need of a new filter and the user subsequently notified and/or provided instructions on how to order or obtain the new filter for the refrigerated appliance.

* * * * *